US011654377B1

(12) United States Patent
Cao

(10) Patent No.: US 11,654,377 B1
(45) Date of Patent: May 23, 2023

(54) BUILDING BLOCK

(71) Applicant: SHENZHEN EIGHTEEN NINE TECHNOLOGY CO., LTD., Shenzhen (CN)

(72) Inventor: Kai Cao, Shenzhen (CN)

(73) Assignee: SHENZHEN EIGHTEEN NINE TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/972,737

(22) Filed: Oct. 25, 2022

(51) Int. Cl.
*A63H 33/08* (2006.01)

(52) U.S. Cl.
CPC ..... *A63H 33/086* (2013.01); *A63H 33/088* (2013.01)

(58) Field of Classification Search
CPC .... A63H 33/062; A63H 33/065; A63H 33/08; A63H 33/086; A63H 33/088
USPC ..... 446/106, 120, 121, 124, 125, 128
See application file for complete search history.

(56) References Cited

U.S. PATENT DOCUMENTS

D169,482 S * 5/1953 Henke et al. ..... D25/113
D290,627 S * 6/1987 Dideriksen ..... 446/128
4,758,196 A * 7/1988 Wang ..... A63H 33/08 52/645
4,826,464 A * 5/1989 Bertrand ..... A63H 33/042 446/124
4,895,548 A * 1/1990 Holland ..... A63H 33/044 446/124
5,645,463 A * 7/1997 Olsen ..... A63H 33/04 446/104
5,947,787 A * 9/1999 Cyrus ..... A63H 33/42 446/105
6,554,678 B2 * 4/2003 Lavender ..... A63H 33/04 446/124
9,017,134 B1 * 4/2015 Christian ..... A63H 33/084 446/124
9,636,602 B1 * 5/2017 Samo ..... A63H 17/002
10,232,280 B2 * 3/2019 Koyun ..... A63H 33/105
11,491,413 B2 * 11/2022 Anderson ..... A63H 33/042
2010/0330867 A1 * 12/2010 Fogel ..... A63H 33/062 446/124
2013/0252503 A1 * 9/2013 Kwok ..... A63H 33/086 446/102
2014/0308872 A1 * 10/2014 Petillo ..... A63H 33/088 446/127

(Continued)

*Primary Examiner* — Joseph B Baldori
(74) *Attorney, Agent, or Firm* — Daniel M. Cohn; Howard M. Cohn

(57) ABSTRACT

A building block includes a block body of an integrated structure. The block body includes a main body, first splicing portions, second splicing portions, a first raised portion, and two second raised portions. The main body is elongated and horizontally extends from left to right. The first splicing portions horizontally extend outwards from one end of the main body. The second splicing portions obliquely extend forward or backward from a middle position of an upper surface of the main body. An outer side surface of the first raised portion recesses to form first splicing grooves tightly docked with and fixed with first splicing portions or second splicing portions of another building block. Two ends of an upper surface of the main body extend upwards to form the two second raised portions. An upper surface of each of the second raised portions recesses to form second splicing grooves.

8 Claims, 4 Drawing Sheets

(56) References Cited

U.S. PATENT DOCUMENTS

| | | | | |
|---|---|---|---|---|
| 2018/0221782 | A1* | 8/2018 | Almog | A63H 33/086 |
| 2020/0330894 | A1* | 10/2020 | Ashton | A63H 33/042 |

* cited by examiner

BUILDING BLOCK

TECHNICAL FIELD

The present disclosure relates to a field of toy technology, and in particular to a building block.

BACKGROUND

Building blocks are usually cubic toys made of wood or plastic. Generally, decorative letters or pictures are coated on surface of each of the building blocks. Children are able to arrange or structure the building blocks into different styles. For example, the children are able to structure the building blocks into different houses, animals, etc. Structuring the building blocks can develop children's intelligence.

Conventional building blocks only comprise splicing structures arranged on two ends of each of the building blocks. An overall structural strength of the conventional building blocks is fragile, so the conventional building blocks are easy to break, have a short service life, are difficult to structure into a stable polygon structure, and unable to meet requirements of building blocks for an unmanned aerial vehicle (UAV) obstacle. Therefore, it is necessary to raise a solution to solve above problems.

SUMMARY

In view of defects in the prior art, the present disclosure provides a building block, which effectively solves problems that the conventional building blocks have structural strength, are easy to break, have short service life, and difficult to structure into a stable polygon structure.

In order to realize above purposes, the present disclosure provides a building block. The building block comprises a block body. The block body is of an integrated structure. The block body comprises a main body, first splicing portions, second splicing portions, a first raised portion, and two second raised portions. The main body is elongated. The main body horizontally extends from left to right. The first splicing portions horizontally extend outwards from one end of the main body. The second splicing portions obliquely extend upwards from a middle position of an upper surface of the main body. The first raised portion extends upwards from a right end of the main body. An outer side surface of the first raised portion is an inclined surface. The outer side surface of the first raised portion recesses to form first splicing grooves. The first splicing grooves are configured to tightly dock with and fix with first splicing portions or second splicing portions of another building block. The two second raised portions are arranged on the upper surface of the main body. An upper surface of each of the second raised portions is an inclined surface. The upper surface of each of the second raised portions recesses to form second splicing grooves configured to dock with and fix with the first splicing portions of another building block.

Optionally, the block body is made of plastic.

Optionally, first hollow grooves run through the block body from the upper surface of the main body to a lower surface of the main body.

Optionally, two first splicing portions are provided. The two first splicing portions are arranged in a row from front to back of the main body. Two second splicing portions are provided. The two second splicing portions are arranged in a row from left to right of the main body. Two first splicing grooves are provided. The two first splicing grooves are arranged in a row from front to back of the main body. Two second splicing grooves are provided. The two second splicing grooves are arranged in a row from front to back of the main body.

Optionally, each of the first splicing portions is a square block structure.

Optionally, each of the second splicing portions is a right-angle trapezoidal block structure.

Optionally, a lower surface of each of the first splicing portions recesses to form a second hollow groove.

Optionally, a third hollow groove is provided on each of the second splicing portions. Each third hollow groove is defined on a back side each of the second splicing portions.

Compared with the prior art, by arrangements of the first splicing portions, the second splicing portions, the first raised portion, and the two second raised portions, an overall structural strength of the building block of the present disclosure is effective improved; so the building block is not easy to break, service life of the building block is greatly increased, and a plurality of the building blocks of the present disclosure are capable of building into a stable polygon structure, which meets requirements of building blocks for an unmanned aerial vehicle (UAV) obstacle. With a premise of ensuring fun, a structure of the building block is reinforced, so that the building block is able to be used for a long time.

Figure 1:
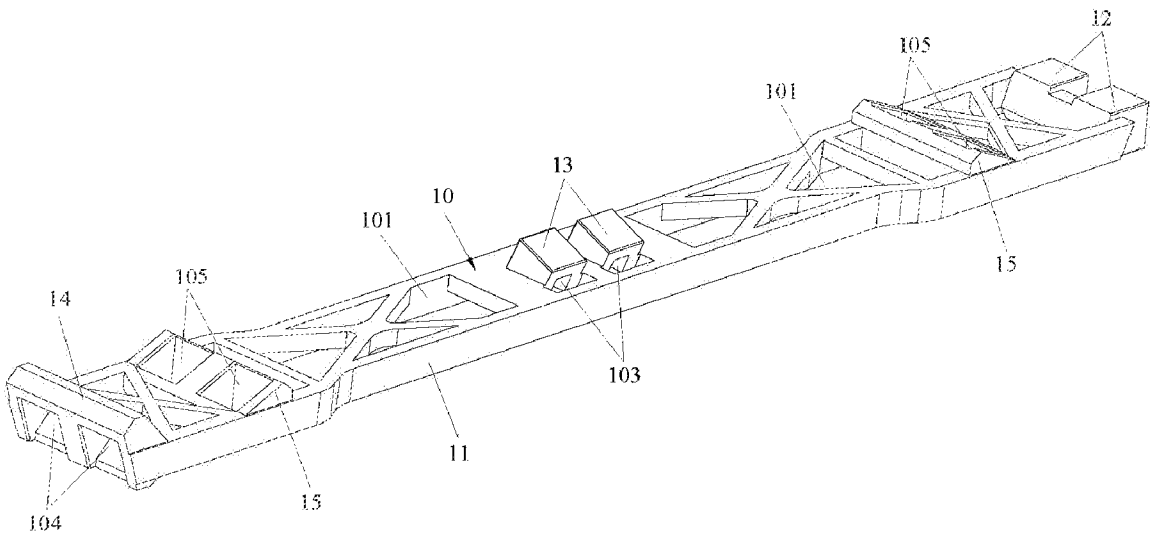
FIG. 1 is a perspective schematic diagram of a building block according to one optional embodiment of the present disclosure.
Figure 2:
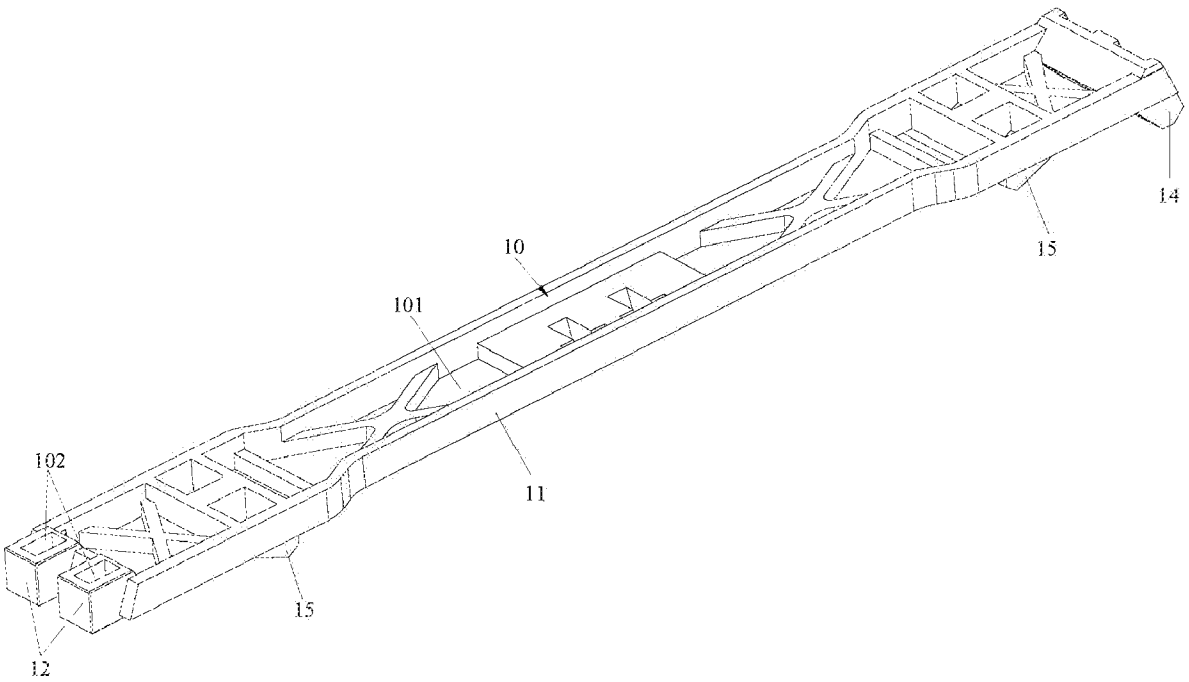
FIG. 2 is another perspective schematic diagram of the building block according to one optional embodiment of the present disclosure.
Figure 3:
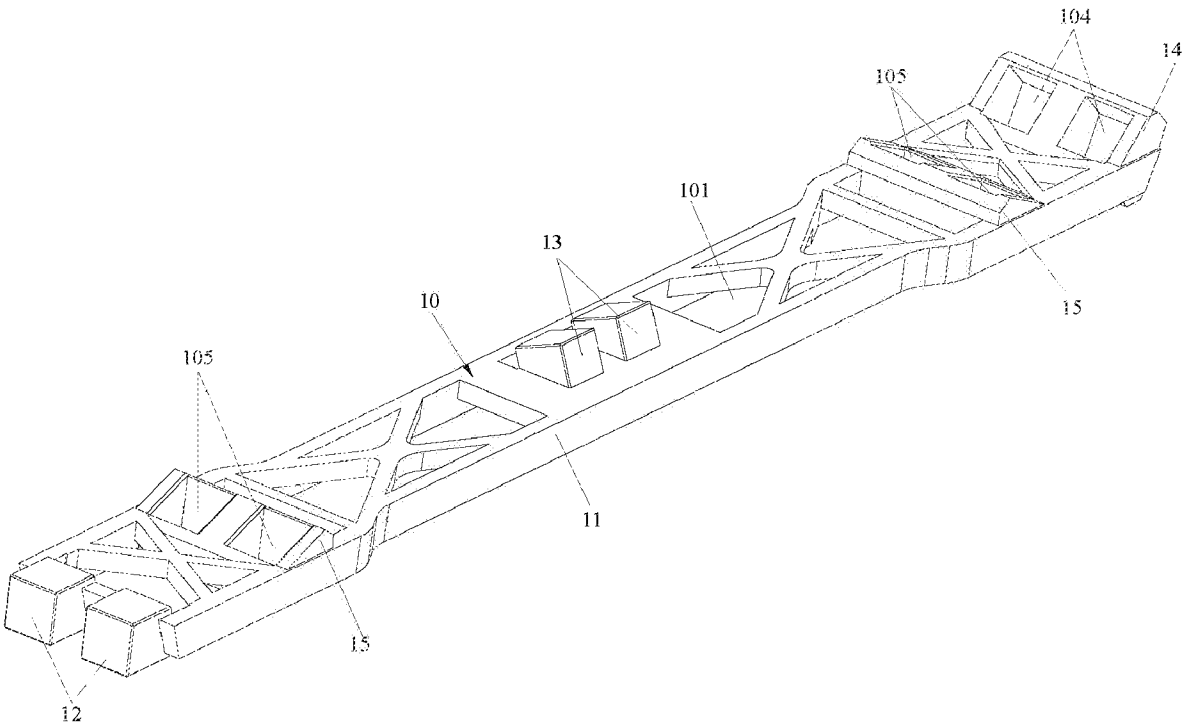
FIG. 3 is another perspective schematic diagram of the building block according to one optional embodiment of the present disclosure.

10—block body; 11—main body; 12—first splicing portion; 13—second splicing portion; 14—first raised portion; 15—second raised portion; 101—first hollow groove; 102—second hollow groove; 103—third hollow groove; 104—first splicing groove; 105—second splicing groove.

DETAILED DESCRIPTION

Please refer to FIGS. 1-4, which show a specific structure of a building block according to one optional embodiment of the present disclosure. The building block comprises a block body 10.

The block body 10 is of an integrated structure. The block body 10 comprises a main body 11, first splicing portions 12, second splicing portions 13, a first raised portion 14, and two second raised portions 15. In the embodiment, the block body 10 is made of plastic, which is simple and easy to make with low cost.

The main body 11 is elongated. The main body 11 horizontally extends from left to right. First hollow grooves 101 run through the block body 10 from an upper surface of the main body 11 to a lower surface of the main body 11. The first hollow grooves 101 have different shapes and sizes, which reduces the material used, reduces weight, and ensures a structural strength, while being aesthetically pleasing and durable.

The first splicing portions 12 horizontally extend outwards from a left end of the main body 11. In the embodiment, two first splicing portions are provided. The two first splicing portions 11 are arranged in a row from front to back of the main body 11. Each of the first splicing portions 12 is a square block structure. Further, a lower surface of each of the first splicing portions 12 recesses to form a second hollow groove 102. By such arrangements, a weight of the building block is reduced by using less material on a premise of ensuring a structural strength of the building block.

The second splicing portions 13 obliquely extend upwards from a middle position of an upper surface of the main body 11. In the embodiment, two second splicing portions 13 are provided. The two second splicing portions 13 are arranged in a row from left to right of the main body 11. Each of the second splicing portions 13 is a right-angle trapezoidal block structure. A third hollow groove 103 is provided on each of the second splicing portions 13. Each third hollow groove 103 is defined on a backside of each of the second splicing portions 13. By such arrangements, the weight of the building block is reduced by using less material on the premise of ensuring the structural strength of the building block.

The first raised portion 14 extends upward from a right end of the main body. An outer side surface of the first raised portion 14 is an inclined surface. The outer side surface of the first raised portion 14 recesses to form first splicing grooves 104. The first splicing grooves 104 are configured to tightly dock with and fix with first splicing portions or second splicing portions of another building block. In the embodiment, two first splicing grooves 104 are provided. The two first splicing grooves 104 are arranged in a row from front to back of the main body. The two first splicing grooves 104 run through the first raised portion.

The two second raised portions 15 are arranged on the upper surface of the main body 11. An upper surface of each of the second raised portions 15 is an inclined surface. The upper surface of each of the second raised portions recesses to form second splicing grooves 105 configured to dock with and fix with the first splicing portions of another building block. In the embodiment, two second splicing grooves 105 are provided. The two second splicing grooves 105 are arranged in a row from front to back of the main body.

Figure 4:
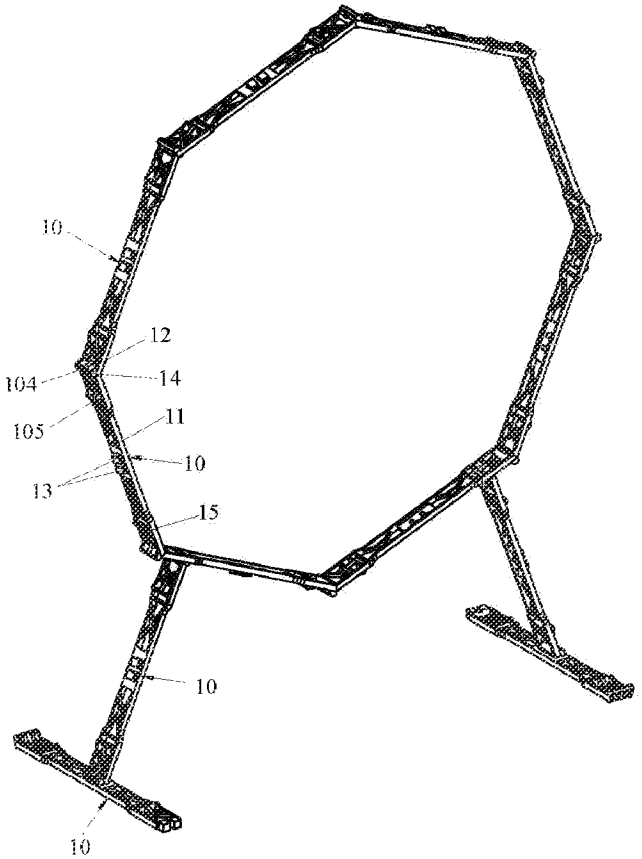
FIG. 4 is a schematic diagram of the building block shown in a configuration of use and according to one optional embodiment of the present disclosure.

When in use, a plurality of building blocks of the present disclosure are provided. The first splicing portions of one of the plurality of building blocks are docked with and fixed with the first splicing grooves of another building block of the plurality of building blocks. The plurality of building blocks are connected in this way to form a polygonal structure. As shown in FIG. 4, the plurality of building blocks are built into an octagonal structure. It is understood that a hexagonal structure, a heptagonal structure, a nine-sided structure, a decagonal structure, an eleven-sided structure and a dodecagonal structure, etc., are built by different numbers of the building blocks, which are not limited thereto. A user can also take four building blocks of the present disclosure and build the four building block into an inverted T-shaped bracket to support the polygonal structure.

By arrangements of the first splicing portions, the second splicing portions, the first raised portion, and the two second raised portions, an overall structural strength of the building block of the present disclosure is effective improved; so the building block is not easy to break, service life of the building block is greatly increased, and the plurality of the building blocks of the present disclosure are capable of building into the stable polygon structure, which meets requirements of building blocks for an unmanned aerial vehicle (UAV) obstacle. With a premise of ensuring fun, a structure of the building block is reinforced, so that the building block is able to be used for a long time.

The above specific embodiments of the present disclosure depict technical principles of the present disclosure. These descriptions are only for explaining the principles of the present disclosure, and cannot be interpreted as limiting of the protection scope of the present disclosure in any way. Based on the explanations, any other specific implementations of the present disclosure obtained by those skilled in the art without creative work should fall within the protection scope of the present disclosure.

What is claimed is:

1. A building block, comprising: a block body; wherein the block body is of an integrated structure; the block body comprises a main body, first splicing portions, second splicing portions, a first raised portion, and two second raised portions; the main body is elongated; the main body horizontally extends from left to right; the first splicing portions horizontally extend outwards from a left end of the main body; the second splicing portions obliquely extend upwards from a middle position of an upper surface of the main body; the first raised portion extends upwards from a right end of the main body; an outer side surface of the first raised portion is an inclined surface; the outer side surface of the first raised portion recesses to form first splicing grooves; the first splicing grooves are configured to tightly dock with and fix with first splicing portions or second splicing portions of another building block; the two second raised portions are arranged on the upper surface of the main body; an upper surface of each of the second raised portions is an inclined surface; the upper surface of each of the second raised portions recesses to form second splicing grooves configured to dock with and fix with the first splicing portions of another building block.

2. The building block according to claim 1, wherein the block body is made of plastic.

3. The building block according to claim 1, wherein first hollow grooves run through the block body from the upper surface of the main body to a lower surface of the main body.

4. The building block according to claim 1, wherein two first splicing portions are provided; the two first splicing portions are arranged in a row from front to back of the main body, two second splicing portions are provided; the two second splicing portions are arranged in a row from left to right of the main body; two first splicing grooves are provided; the two first splicing grooves are arranged in a row from front to back of the main body; two second splicing grooves are provided; the two second splicing grooves are arranged in a row from front to back of the main body.

5. The building block according to claim 1, wherein each of the first splicing portions is a square block structure.

6. The building block according to claim 1, wherein each of the second splicing portions is a right-angle trapezoidal block structure.

7. The building block according to claim 1, wherein a lower surface of each of the first splicing portions recesses to form a second hollow groove.

8. The building block according to claim 1, wherein a third hollow groove is provided on each of the second splicing portions.

* * * * *